US005698146A

United States Patent [19]

Schippers et al.

[11] Patent Number: 5,698,146

[45] Date of Patent: Dec. 16, 1997

[54] METHOD AND APPARATUS FOR SPINNING A SYNTHETIC MULTI-FILAMENT YARN

[75] Inventors: Heinz Schippers; Rahim Gross, both of Remscheid, Germany

[73] Assignee: Barmag AG, Remscheid, Germany

[21] Appl. No.: 612,410

[22] Filed: Mar. 7, 1996

[30] Foreign Application Priority Data

| | | | |
|---|---|---|---|
| Jul. 18, 1995 | [DE] | Germany | 195 26 106.2 |
| Aug. 23, 1995 | [DE] | Germany | 195 30 818.2 |
| Nov. 16, 1995 | [DE] | Germany | 195 42 699.1 |

[51] Int. Cl.[6] ..... D01D 5/16; D01D 10/02; D02G 3/00

[52] U.S. Cl. ..... 264/103; 28/245; 28/246; 264/210.5; 264/210.8; 264/211.12; 264/211.14; 264/211.17; 425/66; 425/377; 425/378.2; 425/379.1; 425/382.2; 425/464

[58] Field of Search ..... 264/103, 210.5, 264/210.8, 211.12, 211.14, 211.17; 425/66, 377, 378.2, 379.1, 382.2, 464; 28/245, 246; 57/310

[56] References Cited

U.S. PATENT DOCUMENTS

| | | | |
|---|---|---|---|
| 4,123,492 | 10/1978 | McNamara et al. | 264/210.5 |
| 4,902,461 | 2/1990 | Schippers | 264/103 |
| 5,148,666 | 9/1992 | Bauer et al. | 57/290 |
| 5,343,601 | 9/1994 | Schippers | 28/258 |
| 5,552,097 | 9/1996 | Schippers | 264/103 |

FOREIGN PATENT DOCUMENTS

| | | |
|---|---|---|
| 118639 | 9/1989 | China . |
| 221464 | 3/1994 | China . |
| 165 625 | 12/1985 | European Pat. Off. . |
| 539 866 | 5/1993 | European Pat. Off. . |
| 40 18 200 | 2/1991 | Germany . |

OTHER PUBLICATIONS

Abstract of Japan 5-171,533 (Published Jul. 9, 1993).

*Primary Examiner*—Leo B. Tentoni

*Attorney, Agent, or Firm*—Bell Seltzer Intellectual Property Law Group of Alston & Bird LLP

[57] ABSTRACT

A method and apparatus for spinning, drawing and winding a synthetic multi-filament yarn, wherein the yarn is subjected after drawing and prior to winding to a heat treatment for purposes of reducing its shrinkage tendency. In the heat treatment, the yarn advances along an elongated heating surface closely adjacent thereto but substantially in no contact therewith. The heating surface has a surface temperature which is above the melt point of the yarn. During the heat treatment, the yarn is subjected to a tension which is lower than the tension required for plastic deformation. The yarn wound by this method has a heat shrinkage tendency which is typically more than about 20%.

36 Claims, 7 Drawing Sheets

METHOD AND APPARATUS FOR SPINNING A SYNTHETIC MULTI-FILAMENT YARN

BACKGROUND OF THE INVENTION

The present invention relates to a method and an apparatus for spinning, drawing, and winding a synthetic multi-filament yarn.

U.S. Pat. No. 4,123,492 discloses a method and apparatus for the spinning, drawing, and winding of a synthetic multi-filament yarn in a single, continuous process. In such process, the yarn tends to shrink, i.e., to shorten, in the package, thereby subjecting the wound yarn to a very high tension which can lead to the destruction of the package. The problem is especially serious in the winding of both nylon 6 and nylon 6.6 (polyamide) yarns, and polypropylene yarns. It is therefore necessary to subject the yarn to a shrinkage treatment before winding, so as to remove its tendency to shrink. However, this additional procedure is undesirable for textile technological reasons, including the fact that the tendency of the yarn to shrink from heat is useful in many subsequent processing operations.

It is an object of the present invention to provide a method and apparatus for spinning a synthetic multi-filament yarn which includes a shrinkage treatment which removes the tendency of the yarn to shrink in the package, yet does not significantly effect the tendency to shrinkage which is caused in particular by a heat treatment or by boiling, and which is desirable and favorable in subsequent processing operations.

It is a more particular object of the present invention to provide a method and apparatus of the described type which includes a treatment which reduces the so-called package shrinkage, i.e., the tendency to cold shrinkage, to a harmless degree, without significantly effecting the hot shrinkage tendency which is useful in many subsequent processing operations.

SUMMARY OF THE INVENTION

The above and other objects and advantages of the present invention are achieved by the provision of a method and apparatus which includes the steps of extruding a polymeric melt to form a plurality of advancing filaments, and gathering the filaments to form an advancing yarn. The advancing yarn is then subjected to a drawing operation, and thereafter the advancing yarn is heated by guiding the advancing yarn along a path of travel which is adjacent but at least substantially spaced from an elongate heating surface. The heating surface is heated to a temperature which is above the melting temperature of the yarn, and during such heating the advancing yarn is subjected to a tension which is insufficient to cause a plastic deformation of the yarn. Finally, the advancing yarn is wound into a package.

Preferably, the temperature of the heating surface is more than about 100° C. above the melting temperature of the yarn, and most preferably, the temperature is between about 200° and 300° C. above the melting temperature of the yarn.

During the heating step, the yarn is subjected to a tension which is not greater than about 0.3 cN/dtex during the heating step, and preferably, the tension is between about 0.1 and 0.2 cN/dtex during the heating step.

The resulting yarn has a hot shrinkage tendency which is greater than about 3%, and the tendency is preferably more than 20%, and most preferably it is between about 30% and about 40%.

An advantage of the present invention is that the textile technological properties of the yarn are not adversely affected by the shrinkage treatment of the invention. In particular, after unwinding, the yarn may still exhibit a high hot shrinkage tendency, which is expressed, for example, as boiling shrinkage. Also, the feed rolls or feed systems, which advance the yarn into the shrinkage treatment zone or withdraw it therefrom, need not be heated. This is not only a substantial simplification of mechanical engineering, but also permits a more favorable control of the process. During the treatment, the yarn is subjected only to a yarn tension which is lower than the tension required for drawing the already oriented yarn. In the case of polyamide, polyester or polytrimethylene terephthalate yarns, the temperature of the heating surface is preferably higher than 350° C., in the case of polypropylene yarns the surface temperature is preferably higher than 200° C.

The present invention permits the yarn to advance in the spin zone and/or shrinkage zone and/or takeup zone under very little tension, without incurring the risk of an unsteady threadline or the formation of laps on the godet or another disturbance of the process.

In the preferred embodiment, the yarn is guided along the heating surface by one or more short guides which are distributed along the surface. This serves the purpose of guiding the yarn at a precisely defined distance from the heated surface. A distance from 0.5 to 3.5 mm is desirable.

As noted above, it is possible to advance the yarn in the shrinkage treatment zone under very little tension. This permits the process to be simplified, in that the yarn tension is adjusted such that it is simultaneously suitable for winding.

In one embodiment, the heat treatment occurs between two yarn feeding godets. This provides an advantage in that it is possible to adjust the yarn tension very uniformly and, thus, the shrinkage in a very controlled manner.

In the short spinning process, the yarns being produced are very susceptible to shrinkage, and they present great problems during the takeup. In this instance, it will be advantageous to utilize an embodiment of the invention wherein the yarn is advanced directly from the spin box to the take-up winder without the use of yarn feeding godets, and at a withdrawal speed which is greater than 5000 m/min, and preferably between 6000 and 7500 m/min.

The method of the present invention is suitable for all polymers in use. It allows to produce a high-quality package of polyester yarn which has still a hot or boiling shrinkage of more than 20% after unwinding.

Especially important is the shrinkage-free treatment for polyamides. The currently conducted shrinkage-free treatments, in particular with vapor, result in an overall reduction of the shrinkage tendency. While the method of the present invention permits removal only of the shrinkage in the package, the shrinkage tendency remains unchanged when heat is supplied, or it remains adjustable by other parameters of the process control.

This applies in like manner to polypropylene yarns, which present in the conventional process significant problems during winding.

An especially advantageous method of drawing in accordance with one embodiment of the present invention includes withdrawing the yarn from the spinneret by means of a godet at a high speed of more than 3,500 m/min. and advancing same through a narrow heating tube. In the heating tube, the yarn undergoes drawing as a result of tension and heating. Until now, this method has been impractical for materials with a strong shrinkage tendency, in particular nylon and polypropylene, since by this kind of drawing the yarns are imparted a high tendency to shrinkage in the package. However, the combination with the method of the present invention allows this draw method to be applied to all types of materials.

Prior to the heat treatment, the yarn may be subjected to a drawing operation wherein the yarn is guided closely adjacent, but at least essentially spaced from an elongate heater which is heated to a temperature higher than the melt point of the yarn, preferably from 100° to 300° C. above the melt point, and the yarn is tensioned to an extent leading to a plastic deformation of the yarn. Despite the low yarn tension in the draw zone, the yarn forms a precisely localized yield point and can be totally drawn. For the formation of a precisely established yield point, the method may be further improved by grinding the advancing yarn over guides, while partially looping the same, before entering into the draw zone.

A further, advantageous variant of the method for the spinning includes withdrawing the yarn from the spinneret at a speed of more than 500 m/min, and so as to result in the simultaneous drawing of the yarn, as is known from EP 0 539 866 A2.

The apparatus of the present invention distinguishes itself in that despite the very high yarn speeds, the heating surface is very short, in particular, in a range from 300 to 1000 mm.

The heater of the present invention may take the form of a generally U-shaped body or rail, which defines a longitudinal heating surface in a groove thereof and with the yarn being guided to have essentially no contact with the heating surface. This construction permits a simple operation and, in particular, a simple selection of the distance at which the yarn advances from the heated surface. In this embodiment, this distance may be predetermined by yarn guides as a function of the yarn material, the denier, the number of filaments, the yarn speed, and the adjusted temperature of the heating surface.

The body or rail of the heater may comprise two separate body segments which are positioned in an end to end relationship, and which have separate temperature controls. Besides a smooth advance of the yarn, this embodiment allows in particular a stepped temperature control that is adapted to the process. For example, a first step is controlled in a temperature range from 450° to 550° C., and the second step in a temperature range from 400° to 500° C.

The invention applies to all polyamides, polyester, as well as polytrimethylene terephthalate (PTT). In the case of polypropylene, the temperatures are correspondingly lower, preferably by 100° C. to 200° C.

A combination of the invention which is especially favorable in terms of process engineering, utilizes in the draw zone a narrow tube surrounding the threadline, into which the yarn advancing from the spinneret enters without passing over a godet. This simple solution of mechanical engineering becomes possible for all materials only as a result of this invention. Where the yarn is withdrawn from the spinning zone by means of an unheated godet or the like, and advanced to the draw zone, the invention requires no special measures to reduce the shrinkage tendency of the yarn already in the draw zone. Thus, additional possibilities of adjustment are obtained, so as to modify the other yarn properties, in particular, tensile strength and elongation. It is possible to spin in particular highly oriented or fully oriented yarns in a continuous process.

Important advantages result from the shrinkage treatment. The invention allows the so-called "package shrinkage", i.e. the tendency to cold shrinkage, to be reduced to a harmless degree, or to be eliminated, without thereby adversely effecting the hot shrinkage tendency, i.e., boiling shrinkage or hot air shrinkage. From the viewpoint of textile technology, it is not desirable to adjust the hot shrinkage tendency to the requirements of winding, but to the requirements of subsequent processing operations. Thus, for example, a certain shrinkage tendency is desired in a sewing yarn, so that the seam can adjust itself to the shrinkage of the fabric. When employing the yarn for hosiery, the leg shape is obtained, in that the untreated hose is pulled over a flat board and adjusts itself to same by heat treatment and shrinkage. In other fabrics, such as corduroy, shrinkage causes the density to increase. In all these cases, the requirement for a shrinkage-free winding in accordance with the invention has no disturbing influence on the tendency to heat shrinkage that is to be achieved.

BRIEF DESCRIPTION OF THE DRAWINGS

Some of the objects and advantages of the present invention having been stated, others will appear as the description proceeds, taken in conjunction with the accompanying drawings, in which.

DETAILED DESCRIPTION OF THE PREFERRED EMBODIMENTS

Figure 1:
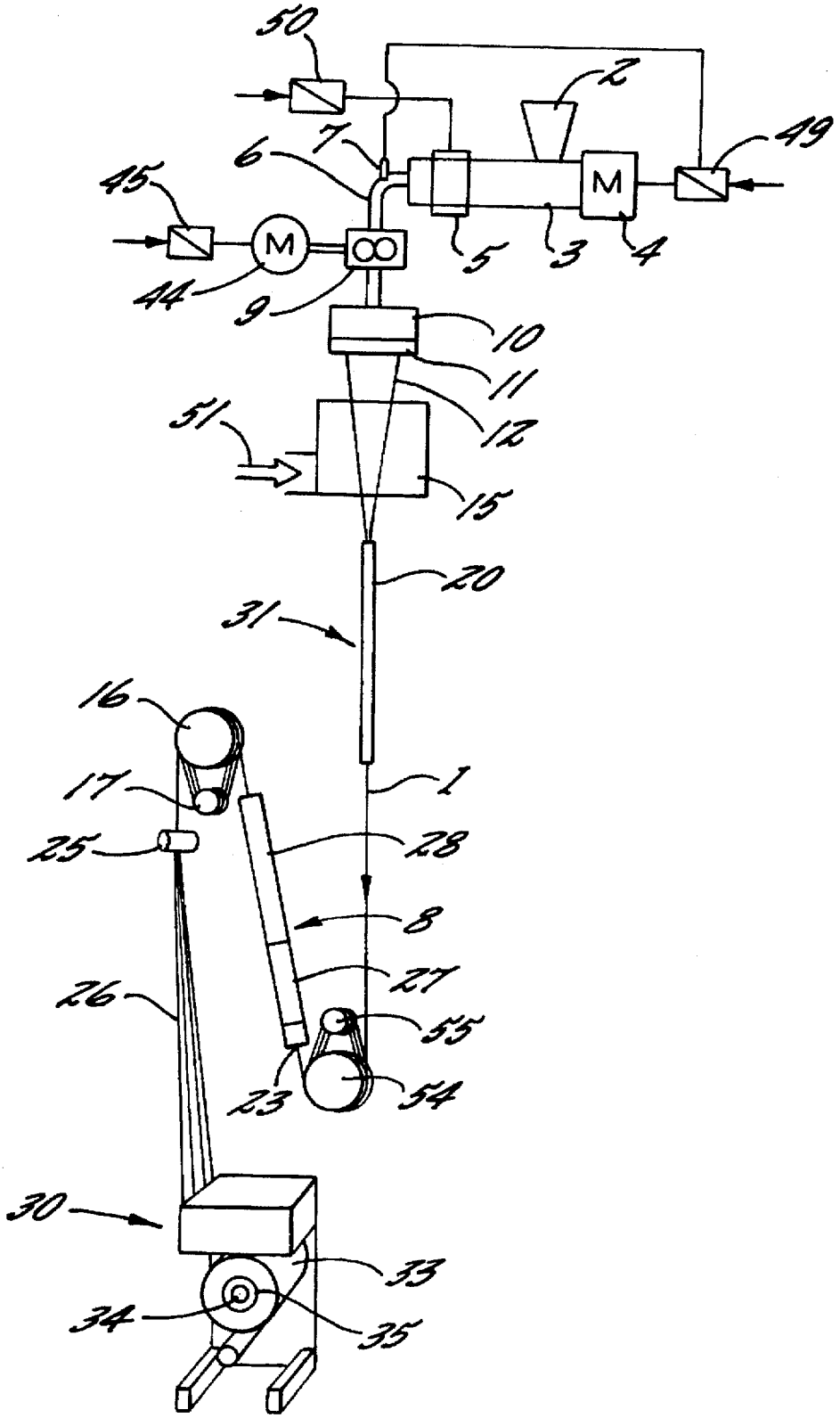
FIG. 1 is a schematic view of the spinning process and the essential elements of an apparatus which embody the present invention.

Referring more particularly to the drawings, FIG. 1 illustrates a melt spinning apparatus wherein a yarn 1 is spun from a thermoplastic material. The thermoplastic material is supplied through a hopper 2 to an extruder 3. The extruder 3 is driven by a motor 4, which is controlled by a control unit 49. In the extruder 3, the thermoplastic material is melted. The work of deformation (shearing energy), which is applied by the extruder 3 to the material, assists in the melting process. In addition, a heater, for example in the form of a resistance heater 5, is provided, which is controlled by a heating control unit 50. Through a melt line 6, which includes a pressure sensor 7 for measuring the melt pressure so as to control the pressure and speed of extruder 3, the melt reaches a gear pump 9, which is driven by a pump motor 44. The pump motor 44 is controlled by a control unit 45, so as to permit a very fine adjustment of the pump speed. The pump 9 transports the melt to a heated spin box 10, the underside of which mounts a spinneret 11. From the spinneret 11, the melt emerges in the form of fine strands of filaments 12. The filament strands advance through a cooling shaft 15. In the cooling shaft 15, an air current is directed crosswise or radially to the web of filaments 12, thereby cooling the filaments.

At the outlet end of cooling shaft 15, the web of filaments is combined to form the yarn 1. The yarn is withdrawn from the cooling shaft 15 and from spinneret 11 by a godet 54.

The yarn loops several times about godet 54. To this end a guide roll 55 is used, which is axially inclined relative to the godet 54. The guide roll 55 is freely rotatable. The godet 54 is driven by a motor at a preadjustable speed. This withdrawal speed is by a multiple higher than the natural exit speed of the filaments 12 from the spinneret, thereby subjecting the yarn to a very high tension, which leads to its drawing. The drawing is assisted by a heating tube 20 which defines a draw heating zone 31. The heating tube 20 measures, for example, 1.150 m long. It is heated to a temperature, which is for polyester and PTT from 140° to 180° C., for polypropylene from 100° to 150° C., and for polyamide from 140° to 220° C. The yield point of the yarn is located in an inlet region of this heating tube. The temperature control in the further extension of the heating tube permits the properties of the yarn, such as its strength, boiling shrinkage, and elongation, to be adjusted. Such a heating tube is described, for example, in DE 38 08 854, which corresponds to U.S. Pat. No. 4,902,461, and also in DE 37 20 337.

The godet 54 is followed by a second godet 16 with a guide roll 17, before the yarn 1 is wound in a takeup 30 to a package 33.

Arranged between godets 54 and 16 is a heater 8 in accordance with the invention. The heater 8 is an elongate body or rail, along which the yarn advances slightly spaced apart therefrom. This elongate heater is divided into several segments, namely a first heating zone 27 and a second heating zone 28 as illustrated, which may be heated independently of each other, as is described in more detail below.

Figure 3:
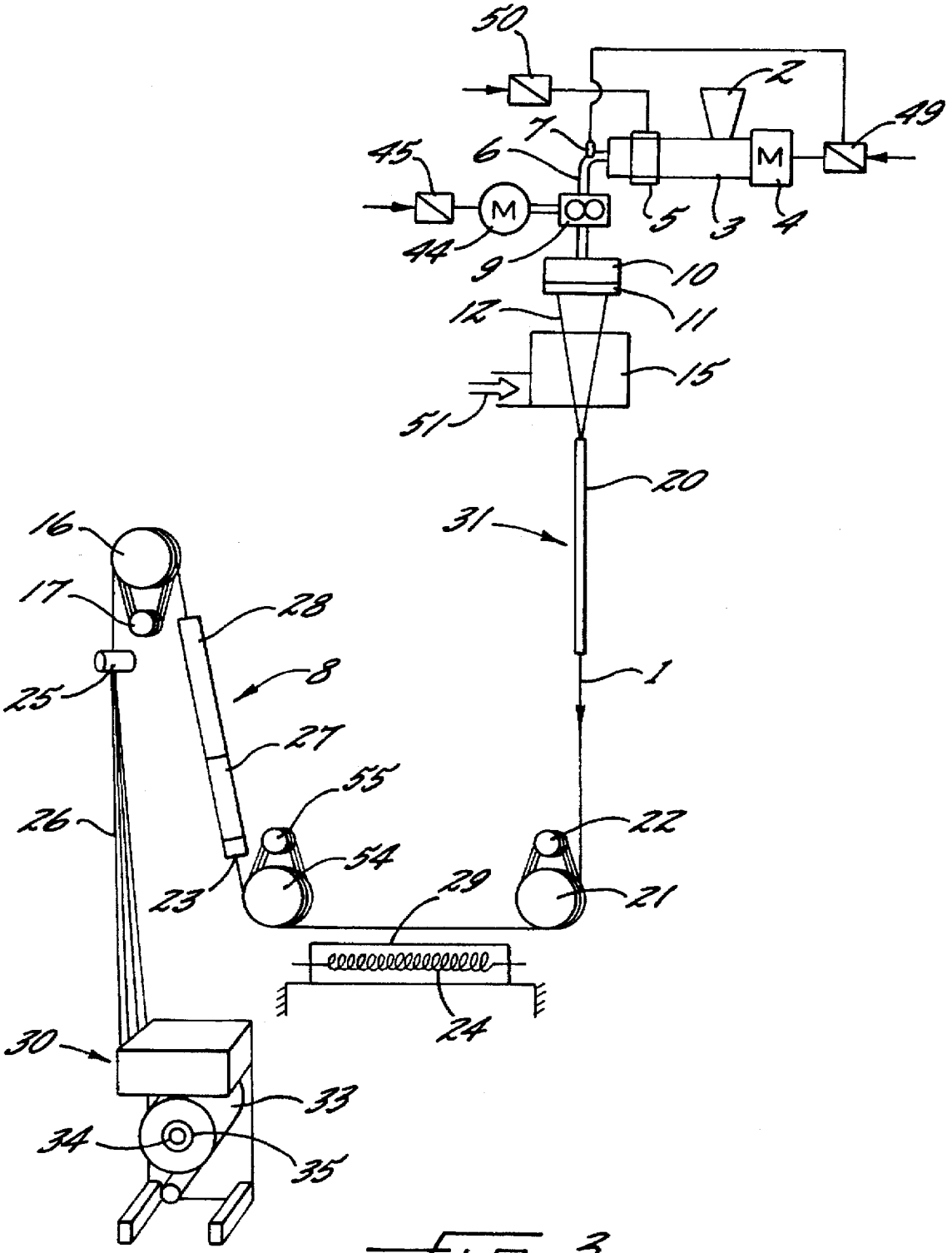
FIG. 3 is a schematic view of a modified spinning process and apparatus which embodies the invention.

From godet 16 of FIG. 1 or FIG. 3, the yarn 1 advances to a so-called "apex yarn guide" 25 and thence to a traversing triangle 26. Not shown in FIG. 1 is the traversing mechanism, which comprises two oppositely rotating blades that reciprocate the yarn 1 over the length of package 33. In so doing, the yarn loops about a contact roll (not shown) downstream of the yarn traversing mechanism. The contact roll lies against the surface of package 33. It serves to measure the surface speed of package 33, which is formed on a tube 35. The tube 35 is clamped on a winding spindle 34. The winding spindle 34 is driven by a motor and a control unit such that the surface speed of package 33 remains constant. To this end and for use as a control variable, the speed of the freely rotatable contact roll is sensed.

It should be noted that the yarn traversing mechanism may also be a standard cross-spiralled roll with a yarn guide traversing in the cross-spiralled groove.

In one embodiment, a polypropylene yarn with a filament denier from 0.7 to 3 dtex is spun and withdrawn from the spinneret 11 by godet 54 and at a speed higher than 3,500 and 4,500 m/min., the yarn being subjected to a sudden heating in heater 8. The godet 16 has a circumferential speed, which is not higher than that of godet 54. Thus, the yarn is not drawn, and it is essentially relaxed as it passes through the heater. In this embodiment, the heater is operated at very high temperatures above the melting point, i.e., substantially above 220° C. The first zone 27 of the elongate heater is heated to 330° C. and the second zone 28 to 150° C. This allows an adequate relaxation treatment between godets 16 and 54 to be achieved, which continues even into the takeup zone. Preferably, the temperatures of the first heating zone 27 are somewhat higher than those of the second heating zone 28, namely in a preferred range from 250° to 550° C. The temperature of the second heating zone 28 is preferably from 150° to 450° C. The yarn tension between godets 54 and 16 can be adjusted to less than 0.1 cN/dtex, taking into account the speed difference and the shrinkage forces. This range is especially advantageous for activating or eliminating the tendency to cold shrinkage. The temperature control, in particular in the second heating zone 28, permits the hot shrinkage tendency to also be influenced in a controlled manner, without thereby adversely affecting the cold shrinkage tendency that is detrimental to winding.

A further godet 21 and guide roll 22 may be arranged upstream of godet 54, as is shown in FIG. 3. In this instance, a subsequent drawing occurs between these godets 21 and 54. To this end, the speed of godet 54 is adjusted higher than the speed of godet 21. A tension is applied, which leads to a further deformation of the yarn 1. Preferably, a further heat treatment also occurs between these two godets. To this end, a heater 24 is shown in FIG. 3. The heater has a heating surface 29 that faces the yarn 1. The yarn 1 advances therealong without contacting, but closely adjacent this heated surface 29, at a distance from 0.5 to 5 mm. The surface temperature is adjusted higher than the melting point of the particular polymer. This subsequent drawing and the sudden heating provided therein allow to achieve an influencing of the crystal structure in the meaning of a greater long-term stability of the yarn. As a result, the effectiveness of the subsequent treatment between godets 54 and 16 is amplified, and the package shrinkage and the tendency to shrink on the package are further reduced.

It should be noted that otherwise the method shown in FIG. 3 corresponds to that described above with respect to FIG. 1. When the methods of FIGS. 1 and 3 are employed, it is possible to wind subsequently both soft and especially shrinkage-sensitive, hard packages, which will not exhibit a detrimental package shrinkage with damage or destruction of the package, even in their long-term behavior. Both methods are carried out in that the yarn is withdrawn from the spinneret 11 at a very high speed of more than 3,500 m/min by means of godet 54 in the instance of FIG. 1, and by means of godet 21 in the instance of FIG. 3. In the case of FIG. 3, the subsequent drawing may amount to another 10 to 30%.

Figure 4:
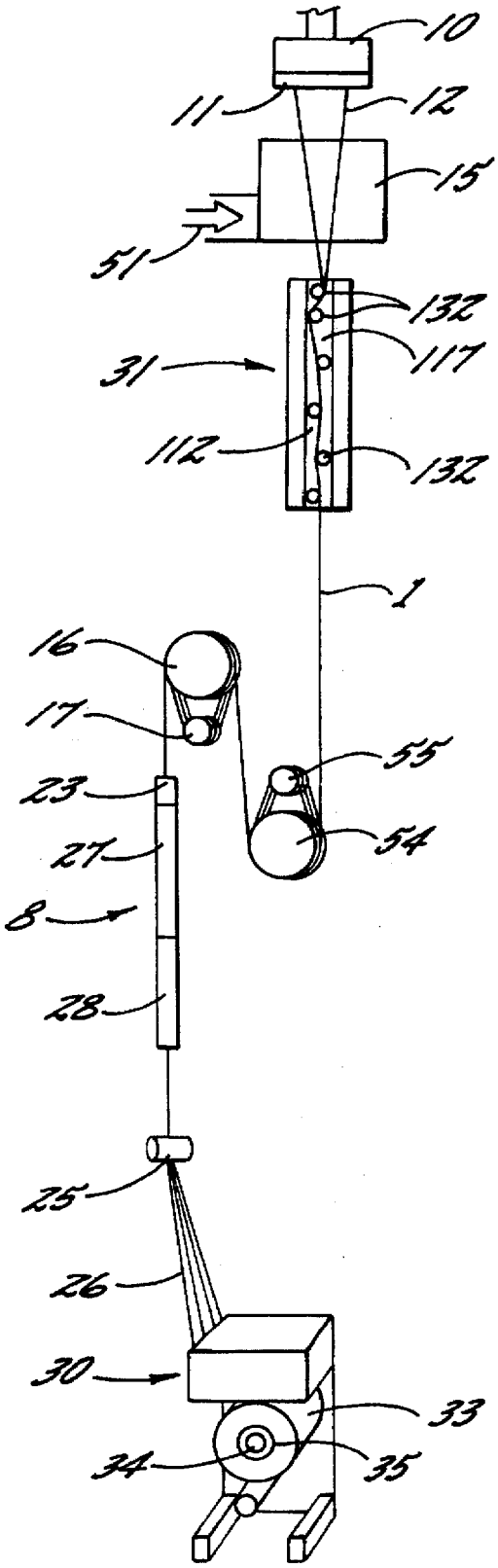
FIG. 4 is a schematic view of a further modified spinning process and apparatus which embodies the invention.

The modification of the crystalline structure and the increase of the length stability, as provided by the process of FIG. 3, may also be produced in a method as shown in FIG. 1, in that the heating tube 20 in the draw heating zone 31 is replaced, as shown in FIG. 4, with an elongate surface, along which the yarn advances without substantially contacting same, the surface temperature, as described with reference to FIG. 3, being above the melt point of the polymer. Unlike in the case of heating tube 20, the necessary draw force is not applied by air friction, but by the friction of the yarn on yarn guides 132. Shown in FIG. 4 is as a further modification that upon its entry into the draw zone, the yarn partially loops about several (shown are two) successively arranged yarn guides 132, so that the yield point of the yarn becomes localized as a result of its heating.

As an alternative to the method shown in FIG. 1, a variant of the method is shown in FIG. 4, which comprises a heat treatment between godet 16 and takeup winder 30. The fact that in the shrinkage treatment zone the yarn may be advanced under very little tension permits an adjustment that makes the yarn tension simultaneously suitable as takeup tension. Since otherwise the sequence of the method shown in Figure corresponds to that of FIGS. 1–3, the description thereof is herewith incorporated by reference.

Figure 5:
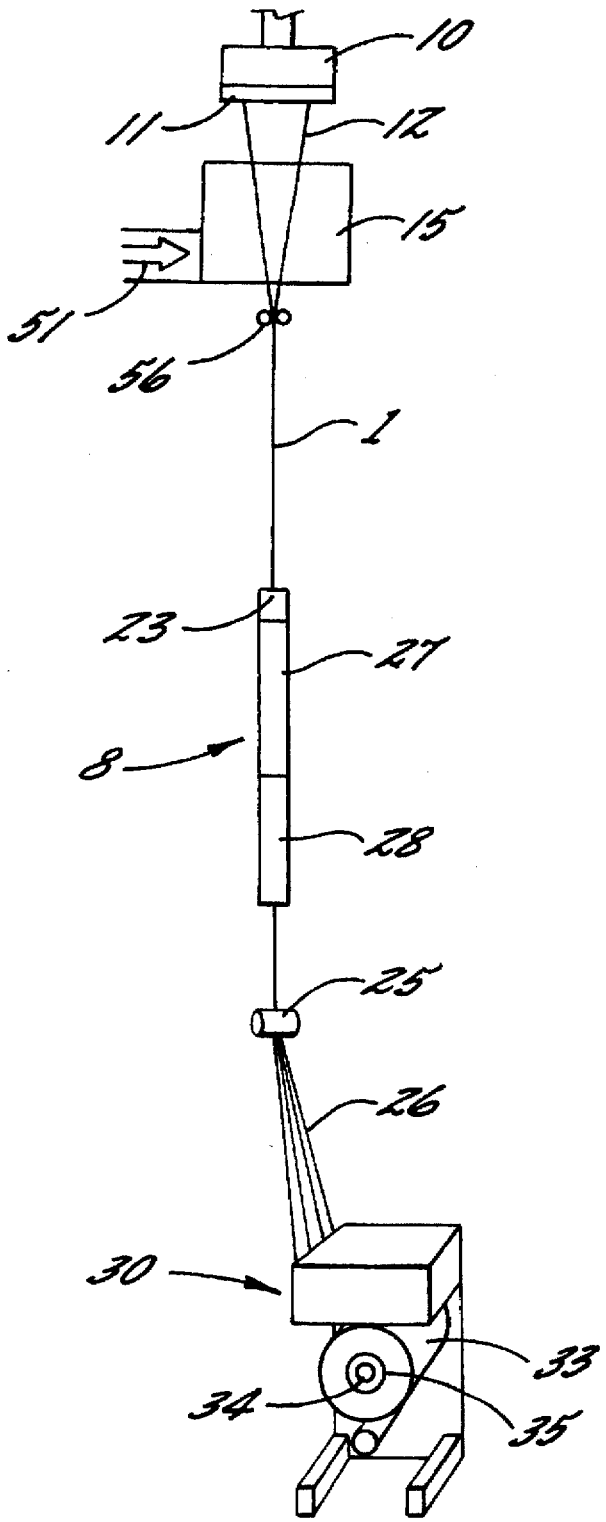
FIG. 5 is a schematic view of another modified spinning process and apparatus which embodies the invention.

In the variant of the method as shown in FIG. 5, the yarn 1 is withdrawn from the spinneret 11 not by godets, but directly by means of takeup winder 30. In this instance, the withdrawal speed is above 5,000 m/min., preferably from 6,000 to 7,500 m/min. In this process, the yarn 1 is drawn simultaneously with the spinning. More particularly, the drawing occurs immediately downstream of the spinneret 11 and while the hot filaments and yarn are being cooled. The drawing ceases at a point wherein the tension supplied by the winder 30 is too low to deform the cooled yarn, and the heater 8 is positioned downstream of the point where drawing ceases, and upstream of the takeup winder 30. Thus during the heating operation in the heater 8, the yarn is subjected to substantially the same tension under which the yarn is withdrawn from the spinneret. This process is particularly suitable for producing without difficulty yarns which are highly susceptible to shrinkage as a result of the spin and draw method. As regards the components of the apparatus not described in this connection, reference may be made to the description of FIGS. 1 and 3.

Figure 6:
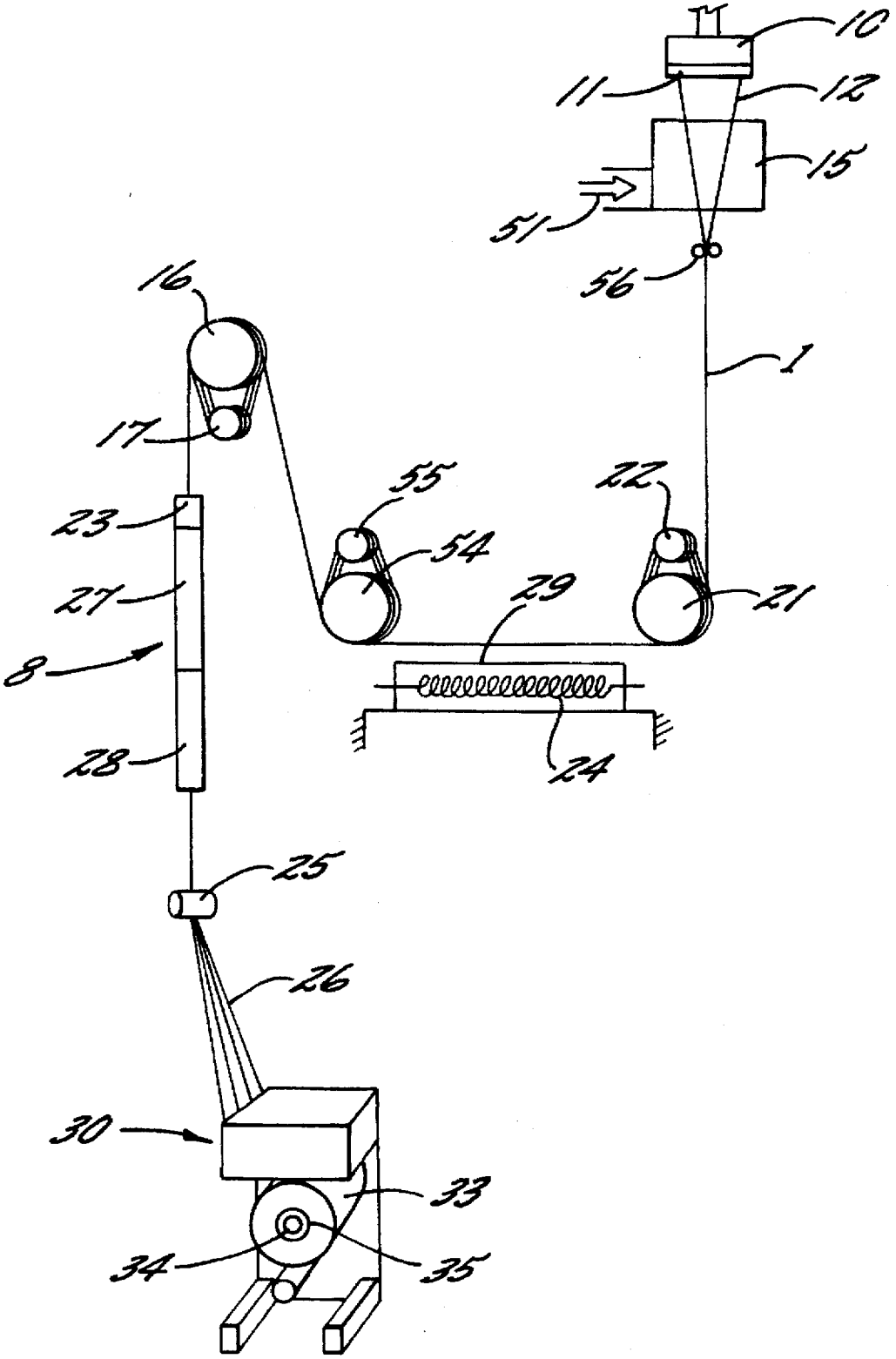
FIG. 6 is a schematic view of still another modified spinning process and apparatus which embodies the invention.

Shown in FIG. 6 is a modification of the method, which does not differ with respect to the shrinkage heat treatment from the method of FIG. 4 that is herewith incorporated by reference. Once the bundle of filaments 12 is combined to yarn 1 by yarn guide 56, the yarn 1 advances to godet 21. The godet 21 being looped by yarn 1 several times withdraws yarn 1 from spinneret 11 and advances the yarn into a draw zone. In the draw zone, a heater 24 is arranged between godet 21 and godet 54. While undergoing a drawing, the yarn 1 advances over the heating surface 29 closely adjacent thereto but without substantially contacting same. The heating surface 29 is heated to a temperature higher than the melt point of yarn 1. The tension required for the drawing is adjusted between godets 21 and 54.

It should be remarked that in all cases, the godets with guide rolls may be replaced with two or more successively arranged, driven rolls, which are looped by the yarn in part in S-direction and/or Z-direction, i.e. successively in opposite direction.

This method has proven that, in particular, the sudden heat treatment at a high temperature results simultaneously in a recovery of the molecular structure of the highly partially oriented polypropylene yarn, so that the residual shrinkage of the yarn is reduced very substantially. In normal processes, the shrinkage-free treatment, i.e. the elimination of the shrinkage tendency, acts to reduce simultaneously both the tendency to cold shrinkage and the tendency to heat shrinkage. This applies in particular to the vapor treatment methods of the prior art. The invention, i.e. a relaxation zone with a sudden heating of the yarn, permits the tendency to cold shrinkage to be selectively eliminated and, preferably, it permits the tendency to heat shrinkage to be influenced in a controlled manner.

It should be pointed out that, contrary to conventional methods, in which all godets for withdrawing, drawing, and relaxing the polypropylene yarn are heated, the godet 54 is unheated, and that it is likewise not necessary to heat godet 16.

It should be added, however, that one of the two godets 54 or 16 may also be heated, for example, to about 100° C., so as to reduce likewise the tendency to heat shrinkage in a controlled manner.

The method of the present invention can be successfully applied to standard polymers, such as polyethylene terephthalate, polytrimethylene terephthalate, polypropylene, and polyamide (preferably, PA 6 and PA 6.6, but also PA blends of different types of PA). Very good results are obtained with polypropylene with a narrow molecular weight distribution in a range smaller than 3, in particular with types produced on the basis of metallocene, inasmuch as these yarns permit the spin-draw process, i.e. spinning and drawing in one operation and in the same zone, as is shown for example in FIG. 1, to be used with a heating tube.

It should be emphasized that a favorable effect can also be achieved by subjecting the yarn to an additional vapor treatment. To this end a hot vapor nozzle 23 is provided directly at the inlet end of the heater 8, which blows hot vapor to the yarn. This hot vapor condenses immediately on the not-yet heated yarn and evaporates thereafter. During the condensation, the yarn receives the corresponding amount of heat. On the other hand, the subsequent evaporation prevents a very sudden heating of the yarn. This protective treatment of the yarn could be advantageous, and will lead in any event to a rapid reduction of the heat shrinkage. The latter can be adjusted by this treatment. Likewise, the following sudden heat treatment at a high temperature results in a reduction of the cold shrinkage. However, the favorable effects of the present invention do not appear to require the use of the hot vapor nozzle.

Figure 2A:
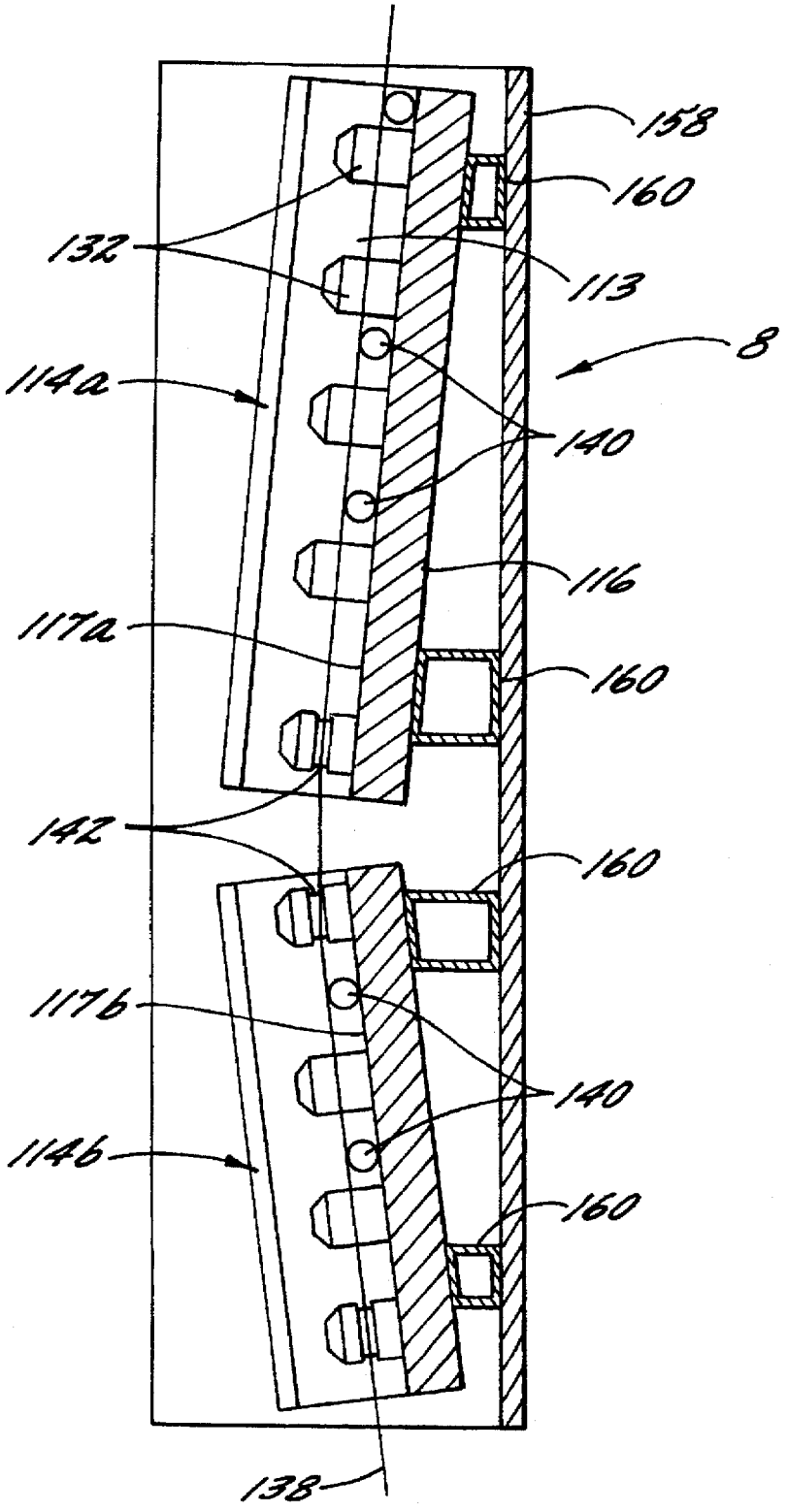
FIGS. 2*a*–2*c* illustrate an embodiment of a heating apparatus for use with the invention.
Figure 2B:
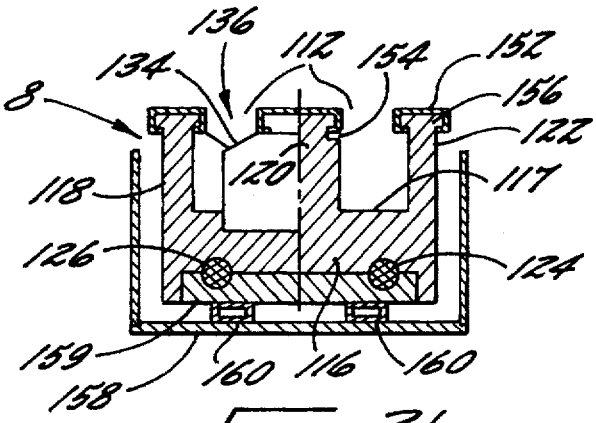
Figure 2C:
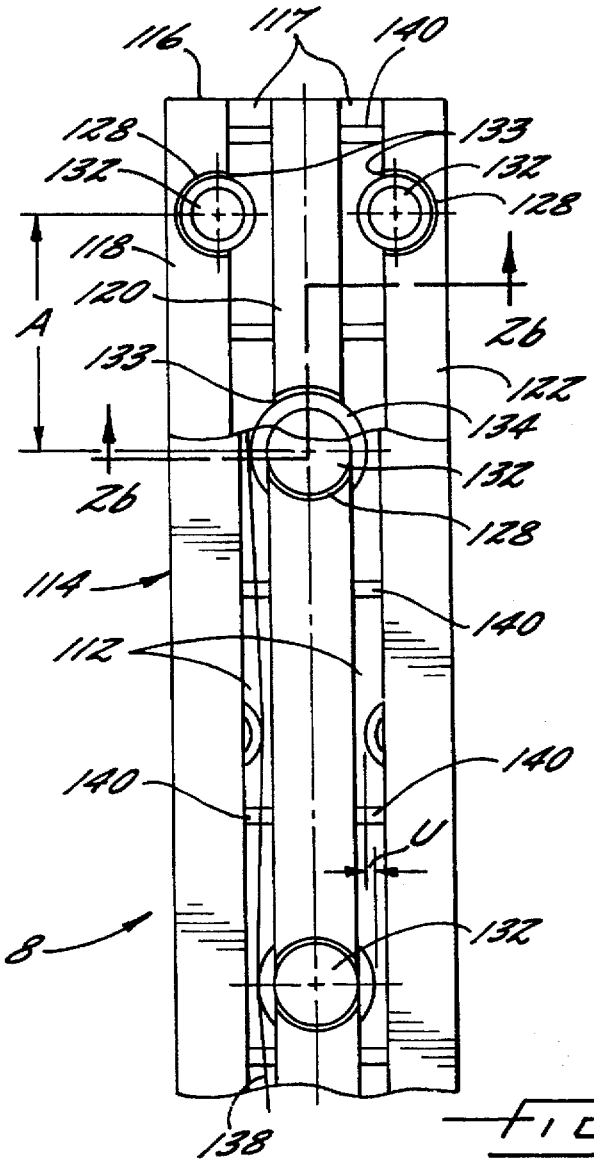

The heating apparatus S, as shown in FIGS. 2*a*–2*c*, consists of an elongate body or rail 114 (FIG. 2*c*) that is provided with two longitudinal grooves 112 and is composed of a material which is heat resistant and nonscaling, and which withstands temperatures in a range above 450° C. over long periods of time without undergoing noteworthy changes. The body 114 is generally U-shaped in cross sectional configuration and includes a substantially flat base portion 116 which constitutes the heating surface 117. Connected with the base portion are three walls 118, 120, 122, between which the longitudinal grooves 112 are located. However, it is also possible to provide base portion 116 with two or more than three upwardly directed walls, between which correspondingly more or less grooves extend. The outer walls 118 and 122 may, for example, be bolted to base portion 116. Arranged between the walls 118 and 122 and the base portion 116 is one heating element 124, 126 each, preferably in the form of a rod-shaped, electrical resistor, which extends over the entire length of body 114, or which may also be divided over the length into several segments, so as to enable controlled heating profiles. The heating elements 124, 126 are provided with plug contacts (not shown) for their connection to a source of current.

Center wall 120 which is located between outer walls 118 and 122 and extends vertically from base portion 116, either is integral therewith, or it is connected with bottom 116 in like manner as outer walls 118 and 122.

As an alternative, the body 114 may have a cross section similar to an extruded profile, in which the base portion 116 and walls 118, 120, 122 are made of one piece, and which is provided in known manner with recesses, bores, bendable flaps, or the like for receiving the heating elements.

Inserted in walls 118, 120, 122 at regular intervals A from one another are recesses or bores 128 having substantially the same depth, the recesses 128 arranged in center wall 120 being offset by the spacing A from the recesses 128 in side walls 118 and 122. The recesses have a circular-cylindrical shape. Each recess 128 is intersected by longitudinal grooves 112 along a secant line, so that walls 118, 120, 122 exhibit a slot 133, i.e. a rectangular opening, facing the axial grooves 112. In the illustrated embodiment, the recesses extend perpendicularly to the groove bottom, and their depth corresponds to the height of walls 118, 120, 122, in which they are accommodated. Under certain circumstances, it may be advantageous to incline the recesses.

Each recess 128 accommodates a yarn guide 132, the cross sectional shape of which corresponds to the cross section of the recess both in size and shape, and which, for purposes of maintaining close tolerances, rests firmly, but with a play, against the wall of the recess. The clearance between the wall of the recesses and the peripheral surface of the yarn guides, as shown in the drawing, is exaggerated only for reasons of clarity. In the region of each slot 133, a portion of each yarn guide 132 extends into the axial grooves 112 such that, on opposite sides of grooves 112, successively arranged yarn guides 132 extend by a certain dimension, for example 0.1 to 1 mm, beyond a central plane extending parallel to walls 118, 120, 122. Otherwise, the width of the slots 133 is smaller than the largest cross sectional dimension, i.e., than the diameter of yarn guides 132, so that they are unable to slide out of recesses 128.

In the illustrated embodiment, both recesses 128 and yarn guides 132 have a circular-cylindrical cross section. Other angular as well as rounded shapes, such as ellipses, diamonds, triangles, etc. are possible. The embodiment has a fit between recesses 128 and yarn guides 132, which is kept within accordingly close tolerances. As a result, separate fastening means to secure yarn guides 132 against axial and radial displacements are not needed, thereby eliminating special expenses, which would otherwise result from the use of fastening means. The embodiment of FIG. 2*c* may also have clearance or transition fits. On the one hand, these fits are narrow enough, so that the yarn guides rest unmovably in their recesses. On the other hand, however, the fits are also selected wide enough, so as to make it easy to pull out the yarn guides from their recesses and replace or omit same.

For purposes of securing the yarn guides in the axial direction, sheet metal caps 152 are used. To this end, side walls 118, 120, 122 are provided on their upper edge with retaining grooves 154 or a head 156, which is wider than the respective wall. In cross sectional view, the sheet metal caps 152 have a cup-shaped profile, so that in the case of center wall 120 they extend into retaining grooves 154, or that in the case of side walls 118, 122 they embrace wall head 156. Otherwise, the sheet metal caps are constructed as elongate profiles, the length of which corresponds to that of the yarn heater. The thickness of wall heads 156 and the position of retaining grooves 154, respectively, as well as the corresponding dimensioning of the sheet metal caps are such that the sheet metal caps secure the yarn guides in the axial direction.

The yarn guides 132 consist of materials commonly used for this purpose, such as silicon, titanium, or aluminum oxides, or of nitrided or chromium plated steel, or the like.

Preferably, in the region in which they project from recess slot 133, the yarn guides 132 are conically beveled on their ends facing away from the base portion 116, as is indicated at 134. As a result, the yarn guides 132 successively arranged in opposite walls 118 and 120, or 122 and 120 form in the cross sectional direction of the heating apparatus 8 respectively a V-shaped groove 136, which permits to guide a yarn 138 in its stretched condition between yarn guides 132, without any special auxiliary measures or arrangements between successive yarn guides 132, in a movement substantially perpendicular with respect to heating surface 112 and base portion 116. There, the yarn 138 resting against the contact surfaces forms then a zigzagged yarn path.

Arranged at the ends or at several other points (see FIGS. 2*a* and 2*c*) of the body 114, and substantially equally spaced apart, are spacers 140, which bridge the groove 112. These yarn guide elements have an upward directed yarn guide surface, which serves to maintain a spacing between the yarn and the groove bottom. These rod-shaped spacers 140 are anchored in transverse bores provided in the walls 118, 120, 122.

As shown in FIG. 2*a*, the heater 8 may consist of two body segments 114*a* and 114*b*, one following the other in direction of the advancing yarn. While these segments differ in length, they otherwise have the same cross sectional shape. The purpose of such a bipartite arrangement may lie in the different heating of heater 8 over different length segments, so as to treat yarn 138 in a heat profile which satisfies its properties. It is also possible to use more than the two illustrated segments. In this arrangement, it is especially important that the angle which the two yarn heating segments form with one another, is identically adjusted at each processing station of the spin-draw machine, so as to produce yarns of the same quality in all processing stations. To mount the two yarn heating segments a mounting support 158 is used, which has the length of the two heater segments. The mounting support has a U-shaped cross section. The yarn heating segments are attached to the bottom of the mounting support by means of spacers 160. The dimensioning of the spacers and their position relative to the heating segment allow to define the inclination of the heating segment with respect to the straight mounting support 158. In this arrangement, the two heating segments are inclined oppositely, and form with each other an obtuse angle. Thus, mounting support 158 is used on the one hand for a specific fastening of the two heating segments. Since mounting support 158 has a U-shaped profile, it embraces, however, also the two heating segments. Therefore, the mounting support 158 also serves to make the temperature constant over the length and width of the heating segments. The mounting support is preferably surrounded by an insulation.

As already indicated, rod-shaped spacers 140 may be provided, which bridge over axial groove 112 on its bottom, i.e., they extend over heating surface 117 and define the yarn path at a specific distance spaced from the groove bottom. Alternatively or additionally, it is possible to provide a few or all yarn guides 132 with a peripheral guide edge, for example, a circumferential groove 142 (FIG. 2*a*), the height of which as measured from the groove bottom, is brought in line with the height of the yarn path that is predetermined by spacers 140. In this manner, the yarn advancing in the groove is guided by the lateral edges of the groove. The circumferential grooves have the same depth over the circumference, i.e., they are made concentric with yarn guides 132. However, it is also possible to construct the circumferential grooves with a depth varying over the circumference, for example, in that the groove bottom is cut circular-cylindrically, but eccentrically with respect to yarn guides 132. In this instance, a turning of the yarn guides creates the possibility of finely adjusting the contact between yarn 138 and yarn guides 132, and of forming a zigzagged yarn path. This could be realized by turning the yarn guides 132 jointly and to the same extent, for example, by means of a linkage (not shown) that interconnects the yarn guides.

The heater 8 is accommodated in an insulated box (not shown), in which it is embedded in a thermally insulated material, for example, fiber glass. The insulated box may be provided with a flap, which permits to open it, so as to provide access to heater 8, and to thread the yarn. Furthermore, the insulated box serves with its components extending over the heater to axially secure yarn guides 132 in the body 114. To this end, the insulated box is provided with slots, which are aligned with the central plane and the bevels 134 of yarn guides 132, and which permit a yarn 138 to be treated to be inserted or threaded between the yarn guides 132. On their side walls, the slots are provided with wear-resistant insulating plates.

Likewise, if need be, the electrical contacts required for heating elements 124, 126 are accommodated in the insulated box.

As can be noted from all embodiments, the peripheral surfaces, on which the yarn contacts the yarn guides, have a relatively large diameter. Contrary thereto, the zigzag line, along which the yarn advances as a result of the overlap U of successive yarn guides, has a relatively small amplitude with a relatively large spacing A between two neighboring yarn guides. This allows the looping angle, at which the yarn loops about the yarn guides or the contact surfaces formed on same, to be small when summed.

In the embodiment of FIG. **2*b*, the heating rail is provided on its side facing away from axial groove 112 with two grooves, which extend substantially below respective ones of the yarn guide grooves 112. Inserted into these grooves are the heating elements 124 and 126. The heating elements are clamped in place by mounting plate 159, which extends over the entire length of the yarn heater. To this end, the mounting plate is likewise provided with grooves, which surround heating elements 124, 126. By detaching the mounting plate 159, the heating elements 124, 126** can easily be exchanged.

The distance of the yarn from heating surface 117 is very small. The distance is in a range from 0.5 to 5 mm. Preferably, the upper value is no more than 3.5 mm, so as to realize a satisfactory transfer of heat and an exact, trouble-free temperature control. For reasons of practicability, the lower limit value is 0.5 mm. As a result, at a correspondingly high temperature of the heating rail of more than 350° C., the yarn undergoes a sudden heating. The yarn guides 132 may also be left out at least in part, or they may be removed, should they have a negative effect. On the one hand, they contribute to smoothing the yarn, but they barely serve to heat the yarn as it advances in contact therewith. On the other hand, the yarn guides exert only little friction on the yarn, because of its small looping. Importantly, however, is the noncontacting advance of the yarn closely adjacent to the highly heated heating surface.

As an alternative to the heater 8 as illustrated in FIGS. **2*a*–2*c***, the heater for reducing the shrinkage tendency may take the form of an externally heated tube, through which the yarn advances without substantial contact between the advancing yarn and the tube. The tube will provide a satisfactory uniform control of the heat and it may be slotted to facilitate thread-up of the yarn.

In the drawings and the specification, there has been set forth preferred embodiments of the invention, and, although specific terms are employed, the terms are used in a generic and descriptive sense only and not for the purpose of limitation, the scope of the invention being set forth in the following claims.

That which is claimed is:

1. A method of spinning a synthetic multi-filament yarn comprising the steps of extruding a polymeric melt to form a plurality of advancing multi-filament filaments, and gathering the filaments to form an advancing yarn, drawing the advancing yarn, and thereafter heating the advancing yarn by guiding the advancing yarn along a path of travel which is adjacent but at least substantially spaced from an elongate heating surface, with the heating surface being heated to a temperature which is above the melting temperature of the yarn, and while subjecting the advancing yarn to a tension which is insufficient to cause a plastic deformation of the yarn, and then winding the advancing yarn into a package.

2. The method as defined in claim 1 wherein the temperature of the heating surface is more than about 100° C. above the melting temperature of the yarn.

3. The method as defined in claim 1 wherein the temperature of the heating surface is between about 200° and 300° C. above the melting temperature of the yarn.

4. The method as defined in claim 1 wherein the yarn is subjected to a tension which is not greater than about 0.3 cN/dtex during the heating step.

5. The method as defined in claim 1 wherein the yarn is subjected to a tension which is between about 0.1 and 0.2 cN/dtex during the heating step.

6. The method as defined in claim 1 wherein the resulting yarn has a hot shrinkage tendency which is greater than about 3%.

7. The method as defined in claim 1 wherein the resulting yarn has a hot shrinkage tendency which is between about 5% and about 40%.

8. The method as defined in claim 1 wherein the heating step includes guiding the advancing yarn by means of a plurality of guides which are spaced apart from each other along the length of said heating surface.

9. The method as defined in claim 1 wherein the heating step includes guiding the advancing yarn from a yarn feeding godet to said heating step, and then directly to the winding step.

10. The method as defined in claim 1 wherein the heating step includes guiding the advancing yarn into contact with two yarn feeding godets which are positioned on respective opposite ends of the heating surface.

11. The method as defined in claim 10 wherein said two yarn feeding godets are unheated.

12. The method as defined in claim 1 wherein the yarn is advanced from the extruding step to the winding step at an advancing speed greater than 5000 meters per minute.

13. The method as defined in claim 1 wherein the polymeric melt is selected from the group consisting of polyester, polyamide, and polypropylene.

14. The method as defined in claim 1 comprising the further step of cooling the filaments immediately after being extruded, and wherein the drawing step includes heating the advancing yarn by passing the yarn through a draw zone heating member and so that the yarn is at least substantially spaced from the heating member.

15. The method as defined in claim 1 wherein the drawing step includes guiding the advancing yarn along a path of travel which is adjacent but at least essentially spaced from an elongate heating member, with the heating member being heated to a temperature which is above the melting temperature of the yarn, and while subjecting the advancing yarn to a tension which is sufficient to cause a plastic deformation of the yarn.

16. The method as defined in claim 15 wherein said heating member comprises an elongate heating surface, and wherein the drawing step includes guiding the advancing yarn by means of a plurality of guides which are spaced apart from each other along the length of said heating surface.

17. The method as defined in claim 1 wherein said polymeric melt comprises polypropylene, and wherein the filaments are subjected to a tension sufficient to cause an initial plastic deformation thereof immediately after the extruding step and during the cooling step, and wherein the yarn is subjected to a subsequent plastic deformation during the drawing step.

18. The method as defined in claim 1 wherein the extruding step comprises passing the polymeric melt through a spinneret while withdrawing the filaments from the spinneret at a speed greater than about 5000 meters per minute, wherein the drawing step occurs immediately downstream of the spinneret and while the filaments are being cooled, .wherein the drawing ceases at a point where the tension is too low to deform the cooled yarn, and wherein the heating step is conducted at a location downstream of the point where the drawing ceases.

19. The method as defined in claim 18 wherein during the heating step the yarn is subjected to a tension which is substantially the same as the tension applied to the filaments during their withdrawal from the spinneret.

20. The method as defined in claim 18 wherein the heating step includes guiding the advancing yarn into contact with two godets which are positioned on respective opposite ends of the heating surface.

21. An apparatus for spinning a synthetic multi-filament yarn comprising means for extruding a polymeric melt to form a plurality of advancing filaments, and gathering the filaments to form an advancing multi-filament yarn, means for drawing the advancing yarn and so as to define a drawing zone, means defining a draw-free zone downstream of said drawing zone and wherein the advancing yard is subjected to a tension insufficient for drawing of the yarn, a heater positioned within the draw-free zone and comprising an elongate heating surface, and means for heating the heating surface to a temperature which is above the melting temperature of the yarn, and a winder positioned downstream of said heater for winding the advancing yarn into a package.

22. The apparatus as defined in claim 21 wherein said heater comprises a plurality of guides for guiding the advancing yarn along a path of travel which is adjacent but at least substantially spaced from the elongate heating surface.

23. The apparatus as defined in claim 21 wherein said heater comprises an externally heated tube so that said elongate heating surface comprises an interior wall of said tube and through which the yarn is adapted to pass while being at least substantially spaced from the heating surface.

24. The apparatus as defined in claim 21 wherein said drawing means includes an unheated godet at the downstream end thereof, and such that the yarn advances through said heater under a tension insufficient to cause a plastic deformation of the yarn.

25. The apparatus as defined in claim 21 wherein said heater comprises an elongate body of generally U-shaped cross sectional configuration so that said heating surface comprises a longitudinal heating groove, and further comprising means for guiding the yarn along the groove so as to be at least substantially spaced from the heating surface.

26. The apparatus as defined in claim 25 wherein said body of said heater comprises a plurality of body segments positioned in an end to end relationship.

27. The apparatus as defined in claim 26 wherein two of said body segments are positioned with respect to each other so as to define an obtuse angle when viewed in side elevation, and wherein the guiding means includes guides arranged at the adjacent ends of said body segment for guiding the advancing yarn between the grooves of the body segments.

28. The apparatus as defined in claim 21 wherein said drawing means further comprises an externally heated tube through which the yarn is adapted to advance so as to be at least substantially spaced from the heated tube.

29. The apparatus as defined in claim 21 wherein said drawing means further comprises a draw zone heater which includes an elongate heating surface, means for guiding the advancing yarn along a path of travel which is adjacent but at least essentially spaced from the elongate heating surface, means for heating the heating surface to a temperature which is above the melting temperature of the yarn, and feed godet means for subjecting the advancing yarn to a tension which is sufficient to cause a plastic deformation of the yarn.

30. The apparatus as defined in claim 29 wherein the means for guiding the advancing yarn comprises a plurality of guides which are spaced apart from each other along the length of said heating surface.

31. The apparatus as defined in claim 21 wherein the drawing zone is directly adjacent the extruding means.

32. The apparatus as defined in claim 21 wherein said drawing means comprises a first feeding godet and a second feeding godet positioned downstream of the first feeding godet, a drawing zone heater positioned between said first and second feeding godets, and means for driving the second feeding godet at a surface speed greater than that of said first feeding godet.

33. The apparatus as defined in claim 32 wherein said drawing means further comprises a second draw zone heater positioned between the extruder means and said first feeding godet.

34. The apparatus as defined in claim 32 wherein said first and second feeding godets are unheated.

35. The apparatus as defined in claim 21 further comprising two unheated yarn feeding godets which are positioned adjacent respective opposite ends of the heating surface of said heater.

36. An apparatus for spinning a synthetic multi-filament yarn comprising means for extruding a hot polymeric melt to form a plurality of advancing filaments, and gathering and cooling the filaments to form an advancing multi-filament yarn, a heater positioned along the path of the advancing yarn and comprising an elongate heating surface, guide means for guiding the advancing yarn through the heater so as to be at least substantially spaced from the heating surface, and means for heating the heating surface to a temperature above the melting temperature of the yarn, and winding means for advancing the yarn from the extruding means and through said heater at a speed of at least 5,000 meters per minute and for winding the advancing yarn into a package, and such that the winding means acts to draw the advancing filaments and yarn until the yarn has cooled to an extent that drawing ceases, and wherein the heater is positioned downstream of the point at which the drawing ceases.

* * * * *